US007168115B2

(12) United States Patent
Davis

(10) Patent No.: US 7,168,115 B2
(45) Date of Patent: Jan. 30, 2007

(54) LIFTING CUSHION AND METHOD FOR TRANSFERRING A PATIENT FROM A CHAIR

(75) Inventor: David T. Davis, Bethlehem, PA (US)

(73) Assignee: Woodlark Circle,Inc., Bethlehem, PA (US)

( * ) Notice: Subject to any disclaimer, the term of this patent is extended or adjusted under 35 U.S.C. 154(b) by 0 days.

(21) Appl. No.: 11/351,506

(22) Filed: Feb. 10, 2006

(65) Prior Publication Data

US 2006/0123550 A1 Jun. 15, 2006

Related U.S. Application Data

(62) Division of application No. 11/005,943, filed on Dec. 7, 2004, now Pat. No. 7,028,350.

(51) Int. Cl.
*A47C 27/08* (2006.01)
*A61G 7/14* (2006.01)

(52) U.S. Cl. ..... 5/655.3; 5/711; 5/712

(58) Field of Classification Search ..... 5/655.3, 5/706, 81.1 R, 81.1 MS, 654, 711, 712, 644, 5/634; 297/452.41
See application file for complete search history.

(56) References Cited

U.S. PATENT DOCUMENTS 2,612,645 A * 10/1952 Boland ..... 5/644
3,137,011 A 6/1964 Fischer
4,048,681 A * 9/1977 Baulch et al. ..... 5/81.1 R
4,517,690 A 5/1985 Wegener
4,932,089 A * 6/1990 Laviero ..... 5/421
4,944,056 A 7/1990 Schroeder et al.
5,060,960 A 10/1991 Branscumb et al.
5,438,722 A 8/1995 Jayamanne
5,505,518 A * 4/1996 Pike ..... 297/242
5,561,873 A 10/1996 Weedling
6,073,291 A 6/2000 Davis
6,659,552 B2 12/2003 Duncan
6,684,425 B2 * 2/2004 Davis ..... 5/615
6,722,502 B1 4/2004 Newman (Continued)

*Primary Examiner*—Alexander Grosz
(74) *Attorney, Agent, or Firm*—Duane Morris LLP

(57) ABSTRACT

An inflatable lifting cushion for an articulated chair including a five-sided polygon capable that is longitudinally aligned on the seat and back of the chair. The cushion includes triangular side walls and at least one interior plenum having an air inlet port enabling air to enter and exit the plenum. A system for transferring a patient is provided including an articulated chair having a back and seat that are arranged to cooperate with one another for movement between an upright position and a reclining position. An inflatable lifting cushion is longitudinally positioned upon the back and the seat of the articulated chair. The inflatable lifting cushion comprises a five-sided polygon including triangular side walls and at least one interior plenum having an air inlet port enabling air to enter and exit the plenum. Another a system for transferring a patient is provided that includes an articulated chair having a back and seat that are arranged to cooperate with one another for movement between an upright position and a reclining position. An inflatable lifting cushion is longitudinally positioned upon the back and the seat of the articulated chair. The inflatable lifting cushion comprises a five-sided polygon including triangular side walls and at least one interior plenum having an air inlet port enabling air to enter and exit the plenum. A transfer mattress is positioned upon the lifting cushion for movement of a patient onto an adjacent bed.

19 Claims, 15 Drawing Sheets

U.S. PATENT DOCUMENTS 6,767,066 B1 7/2004 Tornero
2003/0046766 A1* 3/2003 Martin ..... 5/644
2003/0196270 A1* 10/2003 Leventhal et al. ..... 5/660

* cited by examiner

LIFTING CUSHION AND METHOD FOR TRANSFERRING A PATIENT FROM A CHAIR

This application is a divisional of Ser. No. 11/005,943, filed Dec. 07, 2004, now U.S. Pat. No. 7,028,350.

FIELD OF THE INVENTION

The present invention generally relates to apparatus and methods for moving people and, more particularly, to apparatus and methods for moving a patient from a chair to a bed and vice-a-versa.

BACKGROUND OF THE INVENTION

Periodic patient transfers are required to provide the necessary care for patients that are disabled or who need total care due to paralysis, old age, fracture, comatose condition, post-surgery or other conditions which limit the patient's mobility. Regardless of existing patient transfer devices, nurses in hospitals and long-term care facilities are still manually lifting the patient in and out of bed several times during an eight-hour shift in order to provide proper and necessary patient care. The common practice among nurses for transferring patients between a chair and a bed requires two or more nurses to lift a patient upwardly from a sitting position in a chair and transfer them into a hospital bed. Significantly, lifting a patient from a wheelchair to a bed or a bed to a wheelchair is one of the major causes of work-related injuries among nurses. Many times, lifting a patient has disabled a nurse permanently. Therefore, regardless of existing transfer devices, patients and nurses continue to suffer from a lack of adequate patient transfer devices.

The prior art includes several types of lifters and patient transfer devices to assist nursing care. However, these prior art devices suffer from a number of disadvantages. Thus, existing patient transfer devices are not being used as often as they should be to avoid injuries to hospital workers and to patients.

For example, U.S. Pat. No. 4,944,056, issued Jul. 31, 1990, to Schroeder et al., discloses a method and apparatus for transporting a disabled patient from bed to chair and back to bed. This device was adapted to engage both ceiling and floor, which is often not practical for use in hospitals or the nursing home environment. Although it can raise, lower and carry the patient, using a hoist mounted to the ceiling, it takes up significant space and is time consuming to operate. Moreover, it requires two separate pieces of equipment and may be expensive to maintain.

U.S. Pat. No. 3,137,011, issued Jun. 16, 1964, to Fischer, also discloses a complex patient transfer device with three pieces to perform the transfer. It needs a sling on which to suspend the patient, chains to attach the sling to a hoist and a chair on which to place the patient.

U.S. Pat. No. 5,060,960, issued Oct. 29, 1991, to Branscumb et al., discloses a wheelchair with a lifting device.

Patient handling mattresses are also known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet.

For example, in U.S. Pat. No. 4,517,690, issued to Wegener, an air pallet is disclosed that is formed from upper and lower thin flexible film sheets sealed at their edges to form a plenum chamber. Wegener's air pallet functions to move a load with minimal friction over an underlying generally planar fixed support surface. The bottom thin flexible material sheet is perforated by small diameter perforations such as pin holes at the load imprint area.

U.S. Pat. No. 5,561,873, issued to Weedling, provides an inflatable flexible pallet within which an array of structurally interrelated inflatable chambers are formed to support a load when inflated. The flexible pallet is configured to resist lateral and longitudinal shrinkage of the load support surface, as well as ballooning and hot dogging. Rotational instability is also reduced by providing a greater load surface support area.

U.S. Pat. No. 6,073,291, issued to Davis, provides an inflatable medical patient transfer apparatus that has a combination of transverse partition members and a raised perimeter section to reduce deleterious ballooning and uneven inflation as well as quick emergency deflation. Additional differentially inflatable patient rolling chambers are disclosed on the top of the transfer apparatus to provide assistance to medical personnel in beginning to roll patients reclining or lying upon the transfer apparatus, particularly in a deflated condition on a hospital bed.

Unfortunately, until now such patient transfer mattresses could not be effectively employed to transfer a patient to and from a chair.

SUMMARY OF THE INVENTION

The present invention provides an inflatable lifting cushion for an articulated chair comprising a five-sided polygon capable of being longitudinally aligned on an articulated chair and including triangular side walls and at least one interior plenum having an air inlet port enabling air to enter and exit the plenum.

In one embodiment, an inflatable lifting cushion for an articulated chair is provided that includes a rectangular top wall, a back wall, a base wall, and a pair of spaced apart triangular side walls assembled so as to form a five-sided polygon. The five-sided polygon is capable of being longitudinally aligned upon an articulated chair, and includes at least one interior chamber and an air inlet port enabling air to enter and exit the interior chambers.

In a further embodiment of the invention, a system for transferring a patient is provided including an articulated chair having a back and seat that are arranged to cooperate with one another for movement between an upright position and a reclining position. An inflatable lifting cushion is longitudinally positioned upon the back and the seat of the articulated chair. The inflatable lifting cushion comprises a five-sided polygon including triangular side walls and at least one interior plenum having an air inlet port enabling air to enter and exit the plenum.

In yet a further embodiment of the invention, a system for transferring a patient is provided that includes an articulated chair having a back and seat that are arranged to cooperate with one another for movement between an upright position and a reclining position. An inflatable lifting cushion is longitudinally positioned upon the back and the seat of the articulated chair. The inflatable lifting cushion comprises a five-sided polygon including triangular side walls and at least one interior plenum having an air inlet port enabling air to enter and exit the plenum. A transfer mattress is positioned upon the lifting cushion for movement of a patient onto an adjacent bed.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
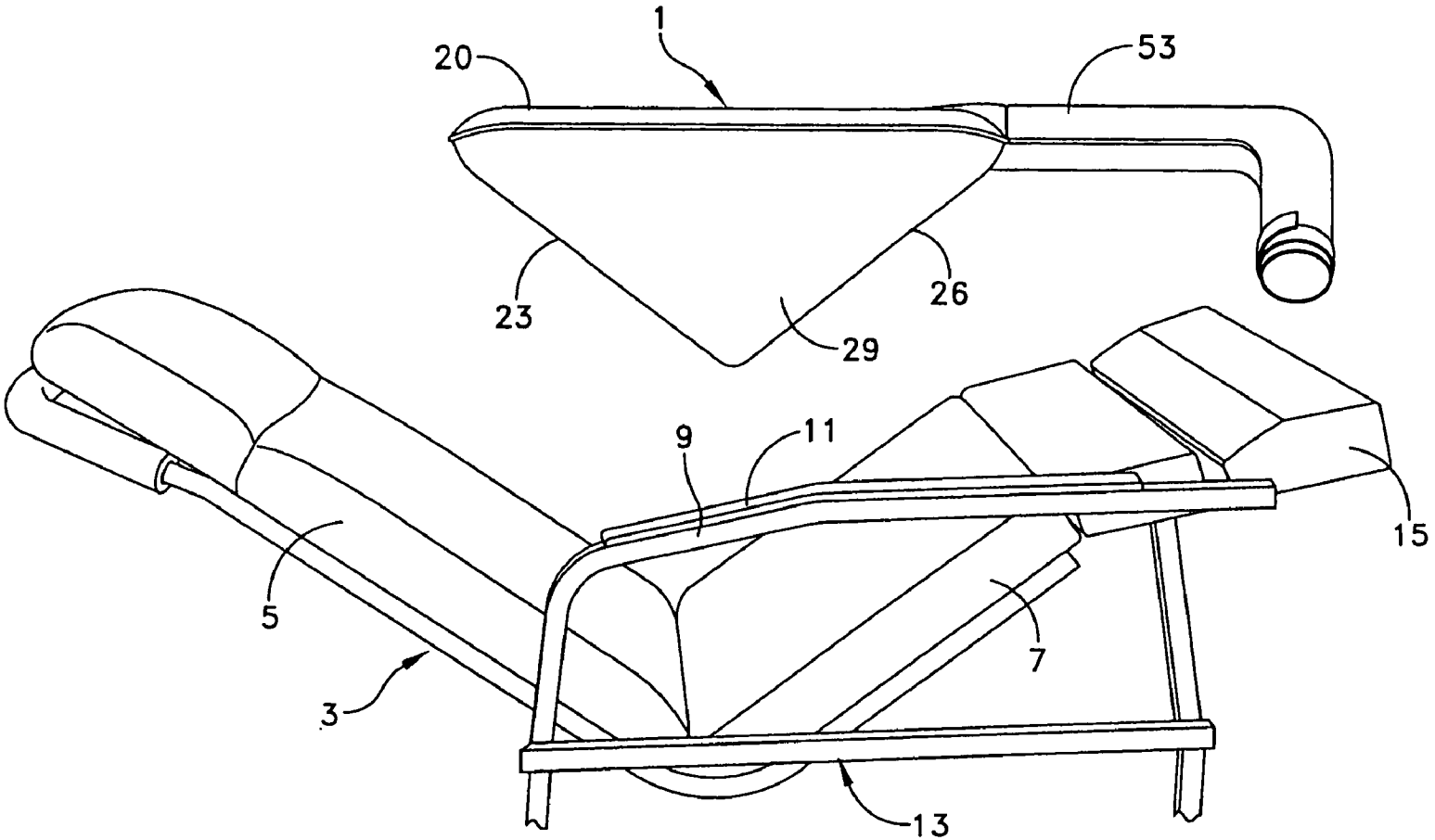
FIG. 1 is an exploded perspective view of a lifting cushion formed in accordance with the present invention and positioned above a typical articulated chair.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIGS. 1–4, the present invention provides a wedge-shaped inflatable support and lifting cushion 1 for use in combination with a reclining articulated chair 3 which, during use, supports the user's back, head and neck. Typically, reclining articulated chair 3 has a back 5 and a seat 7 that can be cooperatively rotated with respect to one another so that back 5 moves from a substantially upright position to a reclining position that approaches horizontal. Often, a pair of parallel, spaced-apart arm rests 9 are arranged adjacent to the outer sides of back 5 and seat 7, with each often including a padded rail 11 that is spaced away from seat 7 and supported by the underlying frame 13 of chair 3. A foot rest 15 extends from an open position substantially level with seat 7, when back 5 is positioned at a reclining angle (FIGS. 1 and 5) and moves to a compact folded position when back 5 is arranged in a fully upright configuration. Back 5 and seat 7 may be formed with opposing frame members from a structurally rigid material, e.g., a metal or engineering polymer, and may be covered with an elastomeric material or may be foam or spring supported so as to provide cushioning for greater sitting or reclining comfort.

Inflatable support and lifting cushion 1 comprises a wedge-shaped, five-sided polyhedron with a substantially rectangular top wall 20, a substantially rectangular back wall 23, a substantially rectangular front wall 26, and two spaced apart, confronting triangular side walls 29, 31. Top wall 20 is often formed from a discrete sheet of nylon scrim or the like, that may be coated on at least its outer surface with a water proof coating, such as any of the well known polymeric or elastomeric compounds that are known to be impervious to semi-solids and liquids, such as, blood, urine, feces, hospital strength disinfecting compounds, alcohol, or the like. Back wall 23 and front wall 26 may form portions of a single sheet of the same material or be discrete sheets. Side walls 29, 31 are comprised of discrete sheets of the nylon scrim, that are often arranged so as to be substantially parallel with one another and perpendicularly aligned with adjacent top wall 20, back wall 23, and front wall 26.

When uninflated, the widths top wall 20, back wall 23, and front wall 26, respectively, are slightly smaller than the width of back 5 and seat 7 of articulated reclining chair 3. The lengths of top wall 20 and side walls 29, 31 are approximately equal to one another. The interior angle between top wall 20 and both back wall 23 and front wall 26, respectively, is approximately 43°–48°, with about 45° being preferred for most applications. The interior angle between both back wall 23 and front wall 26 and side walls 29,31 is approximately 87°–93°, with about 90° being preferred for most applications. The interior angle between back wall 23 and front wall 26 is approximately 87°–93°, with about 90° being preferred for most applications.

Figure 2:
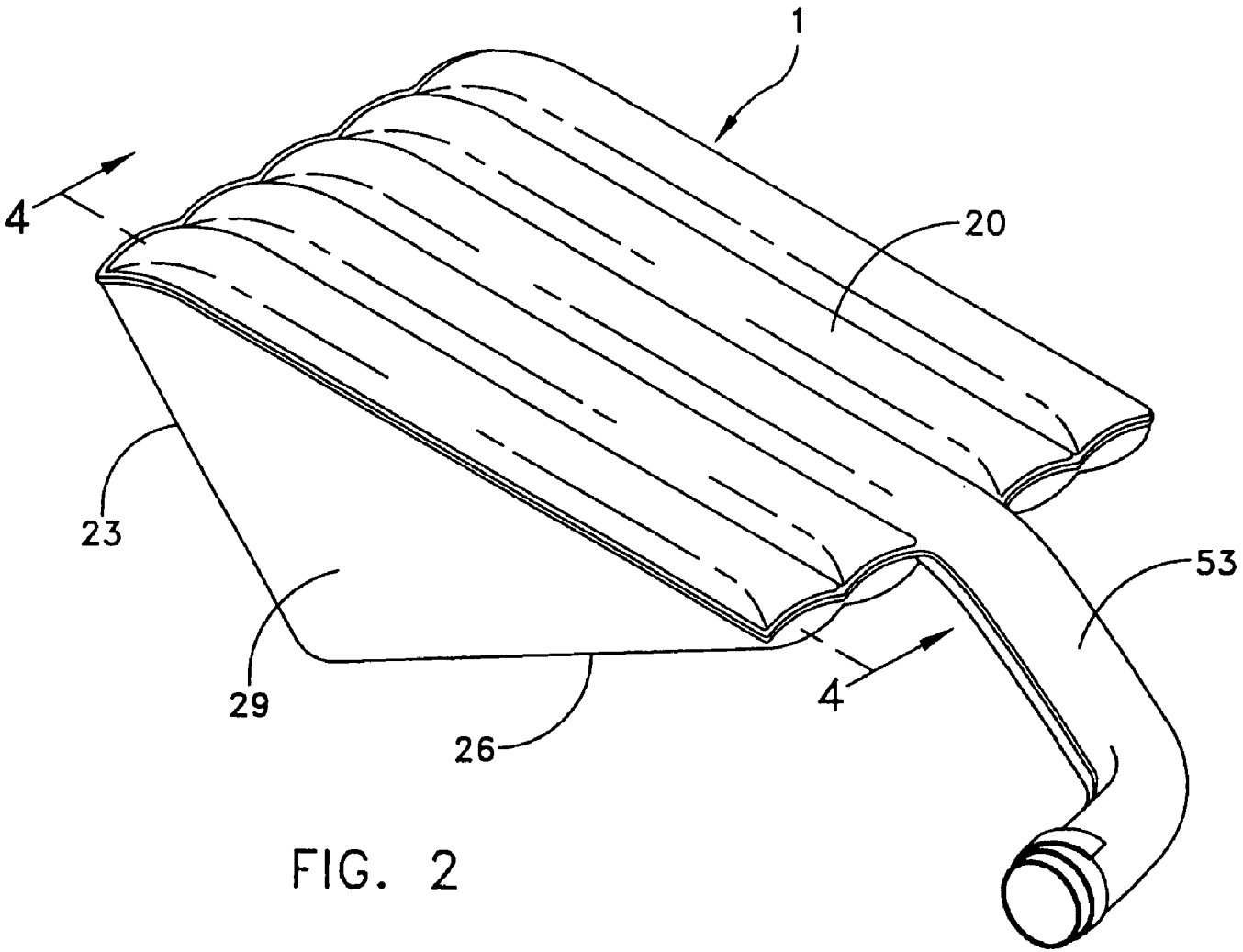
FIG. 2 is a perspective view of the lifting cushion shown in FIG. 1.
Figure 2A:
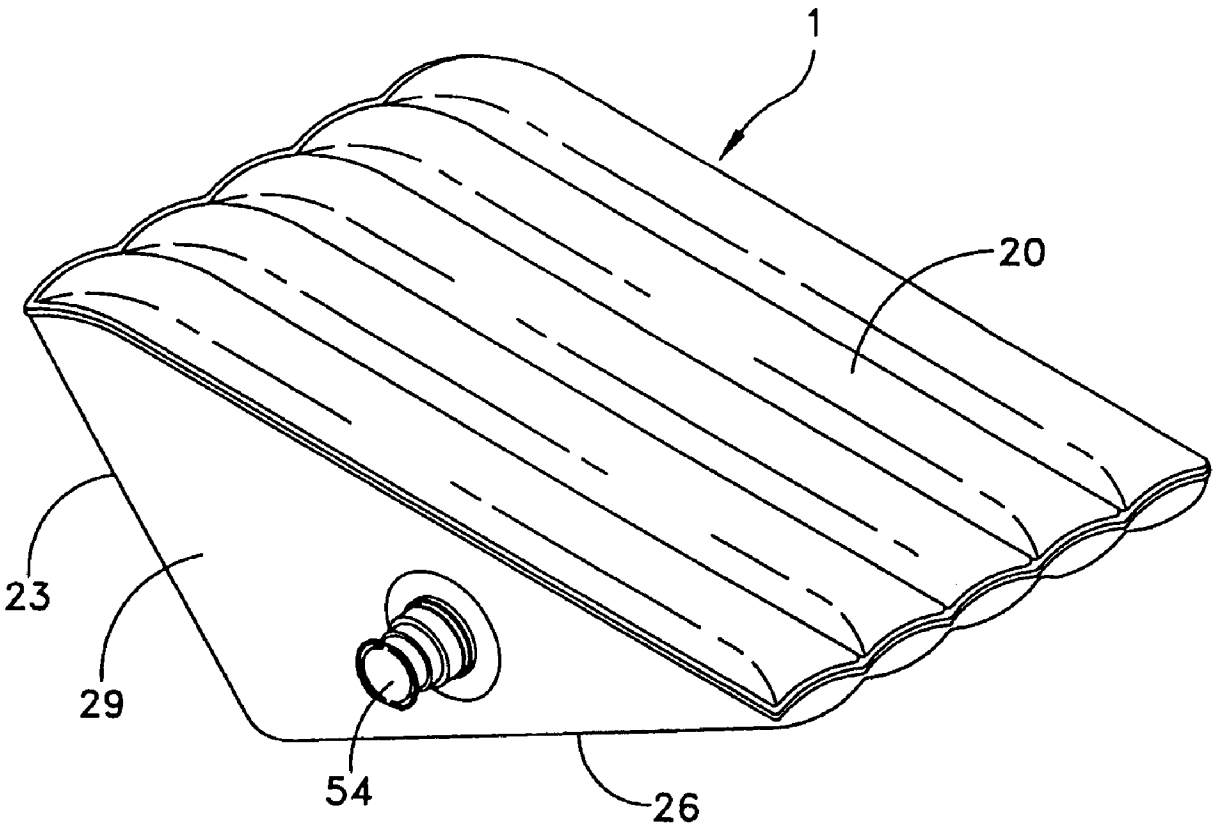
FIG. 2*a* is a perspective view of an alternative embodiment of lifting cushion shown in FIG. 1.
Figure 3:
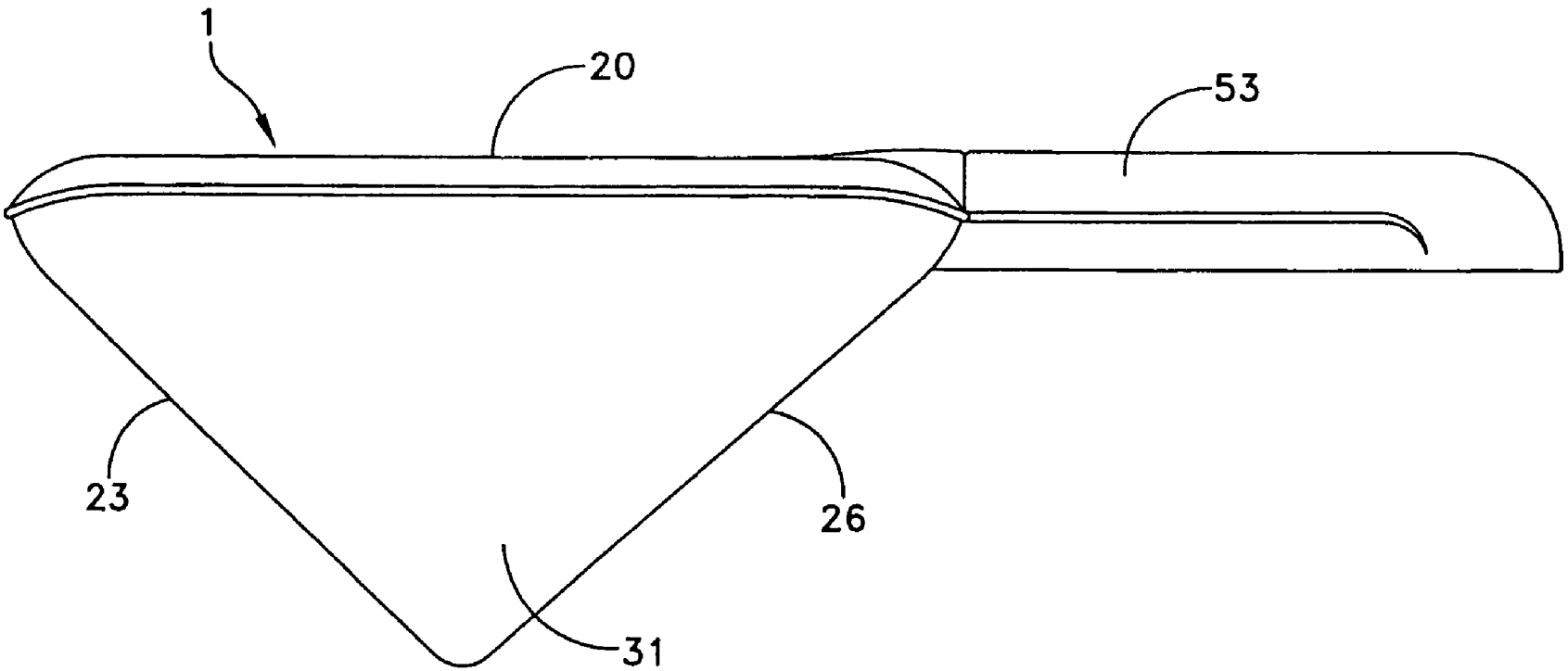
FIG. 3 is a back side view of the lifting cushion shown in FIGS. 1 and 2.
Figure 4:
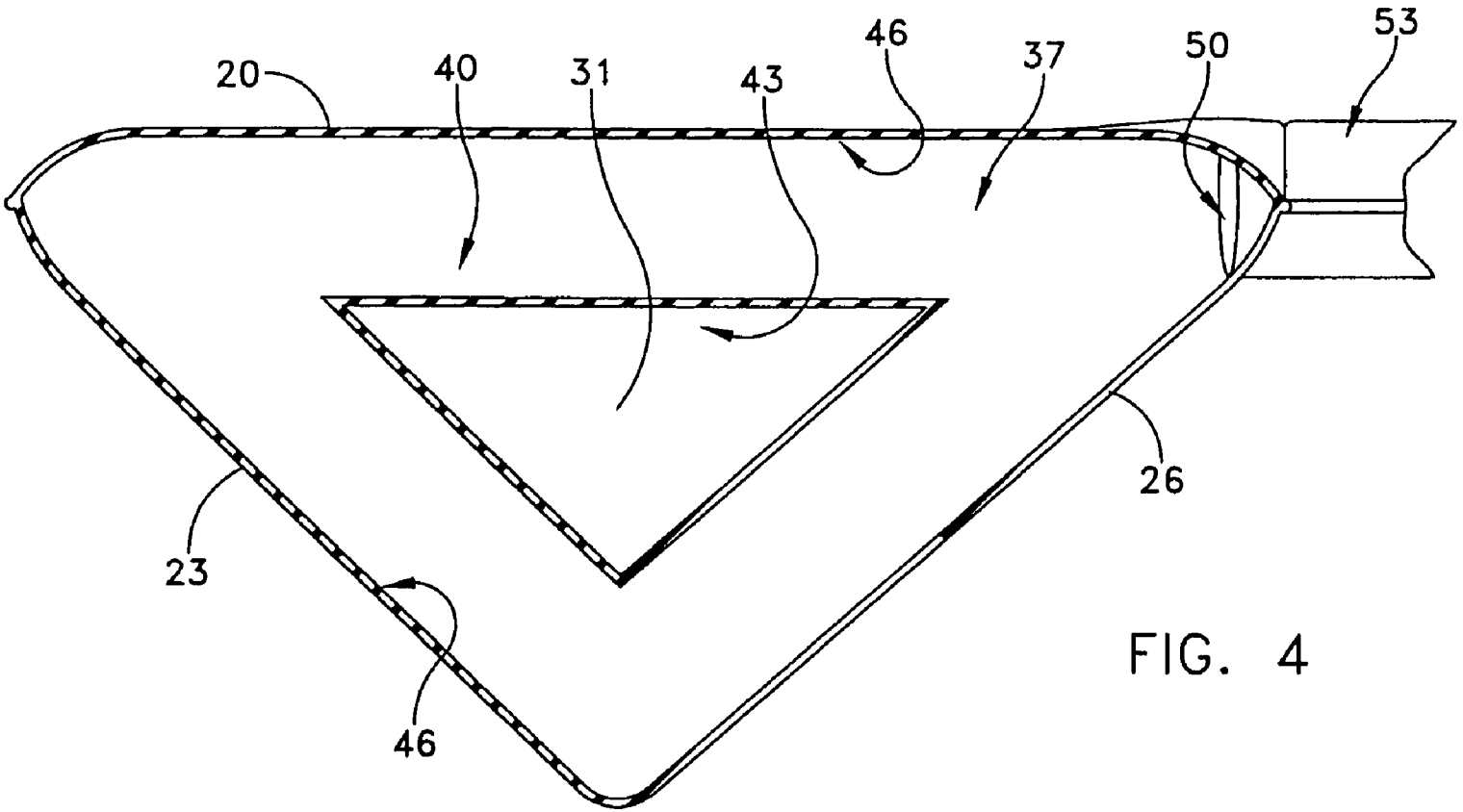
FIG. 4 is a cross-sectional view of a lifting cushion, as taken along line 4—4 in FIG. 2.
Figure 7:
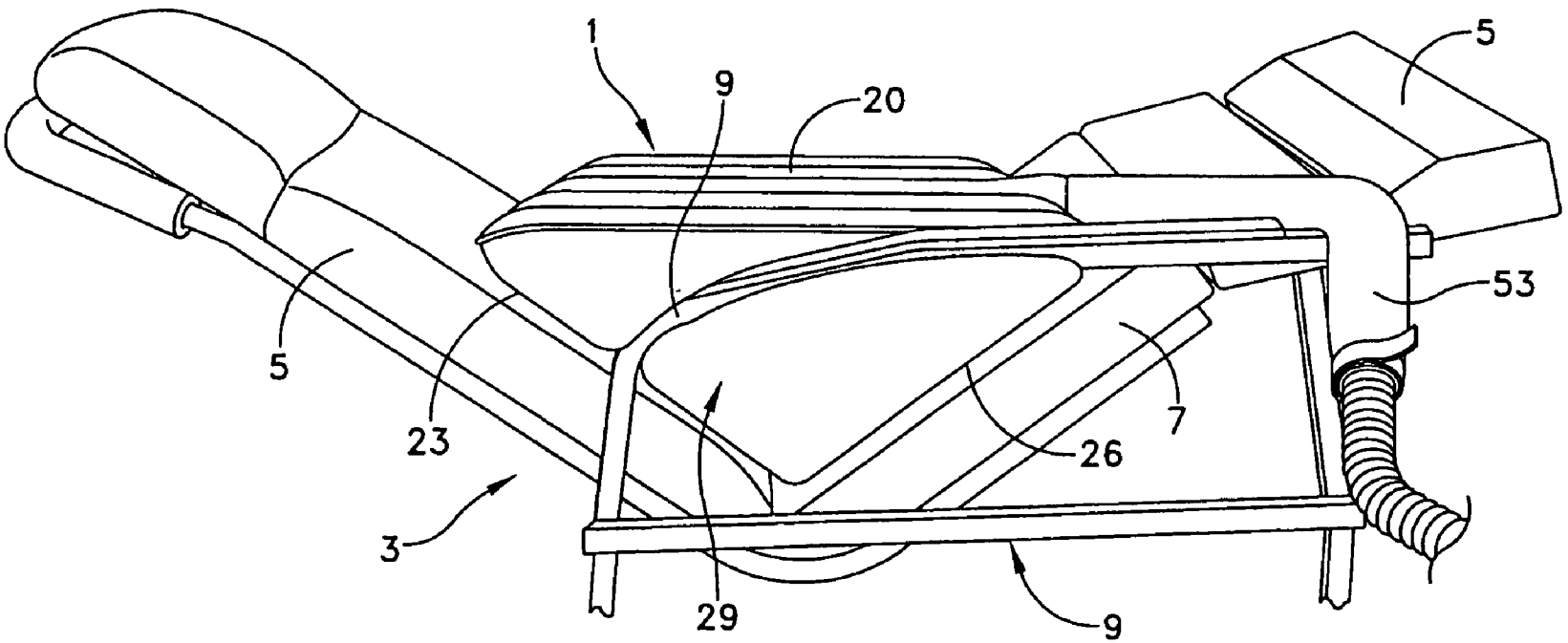
FIG. 7 is a perspective view of a fully inflated lifting cushion formed in accordance with the present invention positioned atop an articulated chair.
Figure 8:
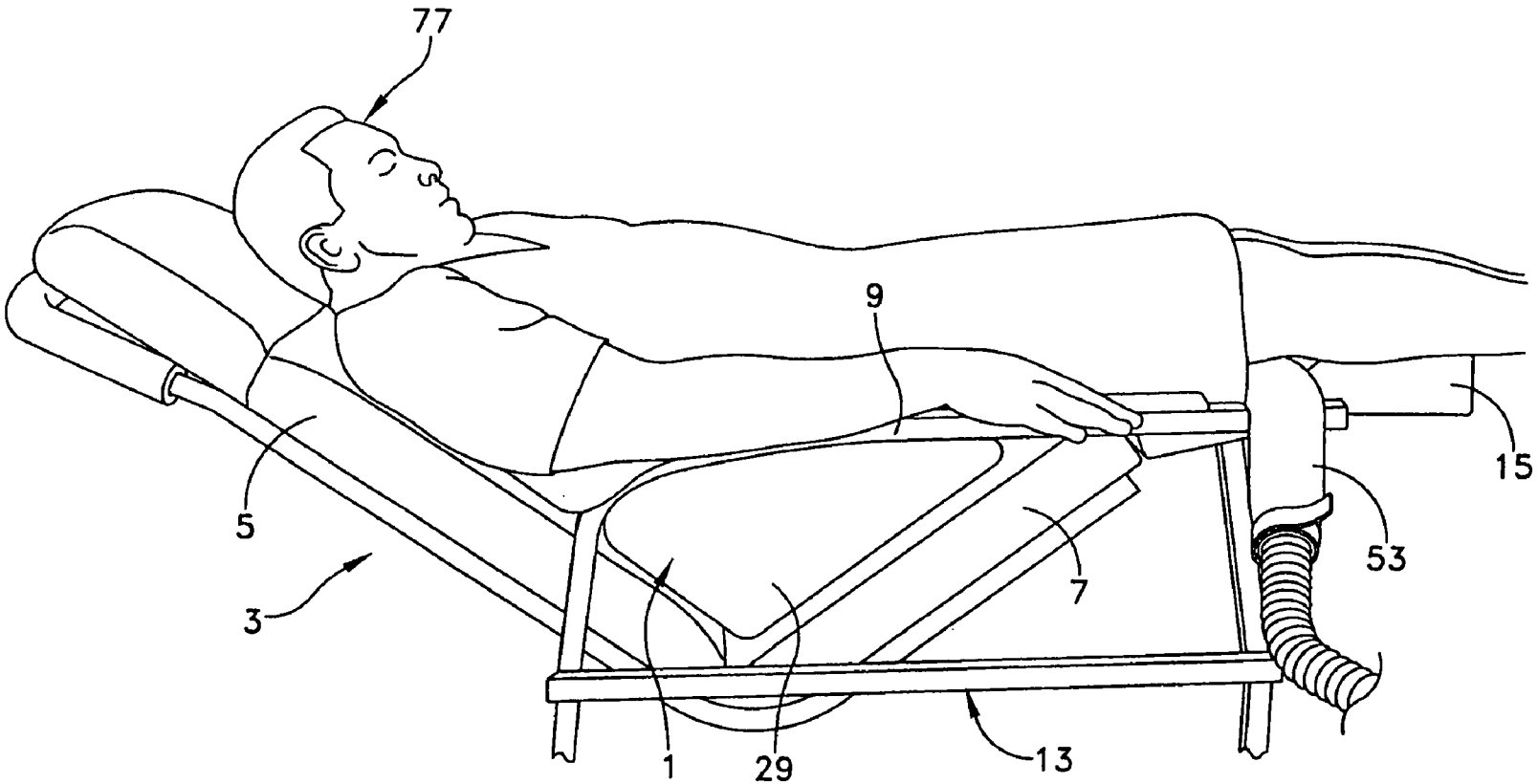
FIG. 8 is a perspective view, similar to FIG. 7, but showing a patient positioned atop the fully inflated lifting cushion.

Referring to FIG. 4, three or more transversely aligned air chambers 37 are structurally separated from one another by stringers 40. Stringers 40 are affixed to and extend between the interior surfaces of top wall 20, back wall 23, and front wall 26. Each stringer 40 comprises a substantially triangular shape having a central opening 43 and a peripheral edge 46. Central openings 43 allow for the passage of an inflating fluid, e.g., ambient air, between respective air chambers 37. Stringers 40 are attached to the interior facing surfaces of top wall 20, back wall 23, and front wall 26, at regular intervals, so as to provide for reduced radial bulging of support and lifting cushion 1. A conduit opening 50 is provided in the corner formed by the intersection of top wall 20 and front wall 26, and is sized and shaped so as to be attached to a source of pressurized fluid (not shown) via a conduit 53. Alternatively, a self-sealing valve 54 may be positioned through one of either side wall 29 or side wall 31 so as to be accessible under arm rest 9 (FIG. 2*a*). Conduit opening 50 is often formed so as to be in fluid communication with one air chamber 37, with central openings 43 being provided between adjacent air chambers 37 so that air is evenly distributed throughout all of the air chambers during inflation, but may exit each air chamber 37 during deflation. Advantageously, side walls 29, 31 are not attached to stringers 40, and therefore have a tendency to bulge outwardly, when support and lifting cushion 1 is inflated on reclining articulated chair 3, so as to engage and grip each of spaced-apart arm rests 9 that are arranged adjacent to the outer sides of back 5 and seat 7, as well as to engage and grip padded rail 11 (FIGS. 7 and 8). In some embodiments, an elastic strap 47 extends in a loop across back wall 23 of. Elastic strap 47 is sized so as to slip over back 5 so that lifting cushion 1 is prevented from slipping from articulated chair 3 when in an uninflated state (FIG. 5).

Figure 5:
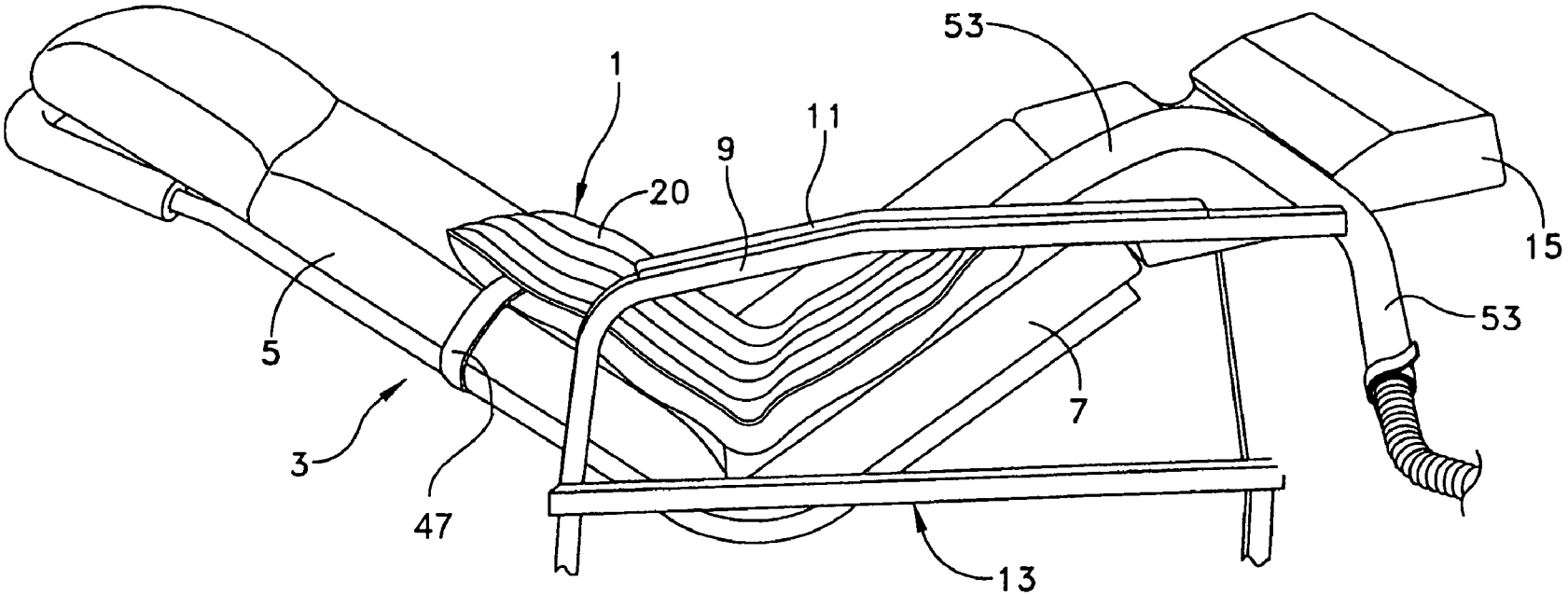
FIG. 5 is a perspective view, similar to FIG. 1, but showing an uninflated lifting cushion positioned on the articulated chair.
Figure 6:
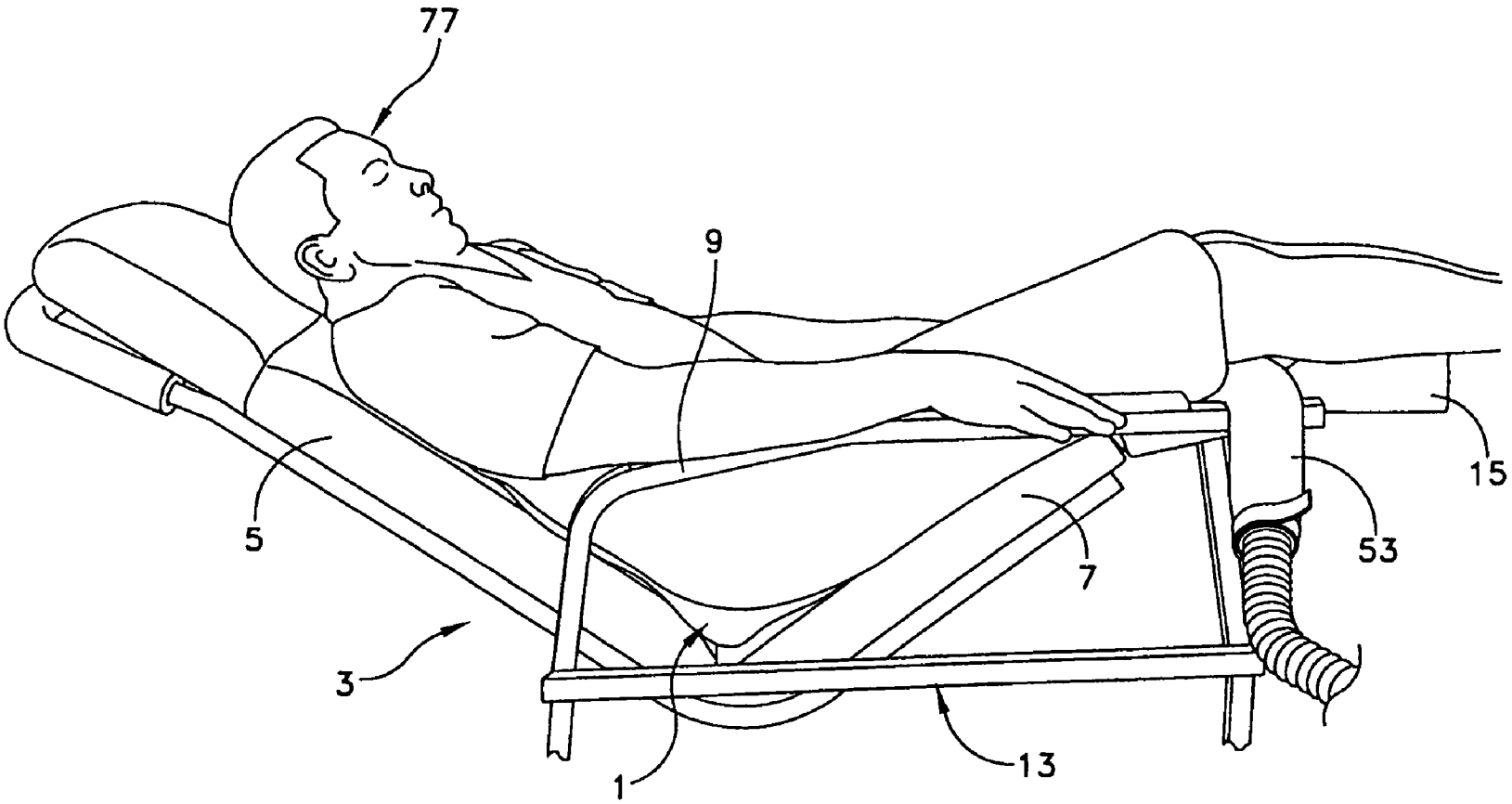
FIG. 6 is a perspective view of the lifting cushion and articulated chair shown in FIG. 5, with a patient positioned atop the lifting cushion.

Referring to FIGS. 1 and 5–10, lifting cushion 1 may be used to transfer a patient from reclining articulated chair 3 to a bed 75 in the following manner. Lifting cushion 1 is first positioned so that back wall 23 is in spaced-apart confronting relation to the top surface of back 5 of articulated reclining chair 3, with front wall 26 positioned in spaced-apart confronting relation to the top surface of seat 7. Once in this position, lifting cushion 1 is moved towards chair 3 until back wall 23 engages back 5 and front wall 26 engages seat 7 (FIG. 5).

Figure 9:
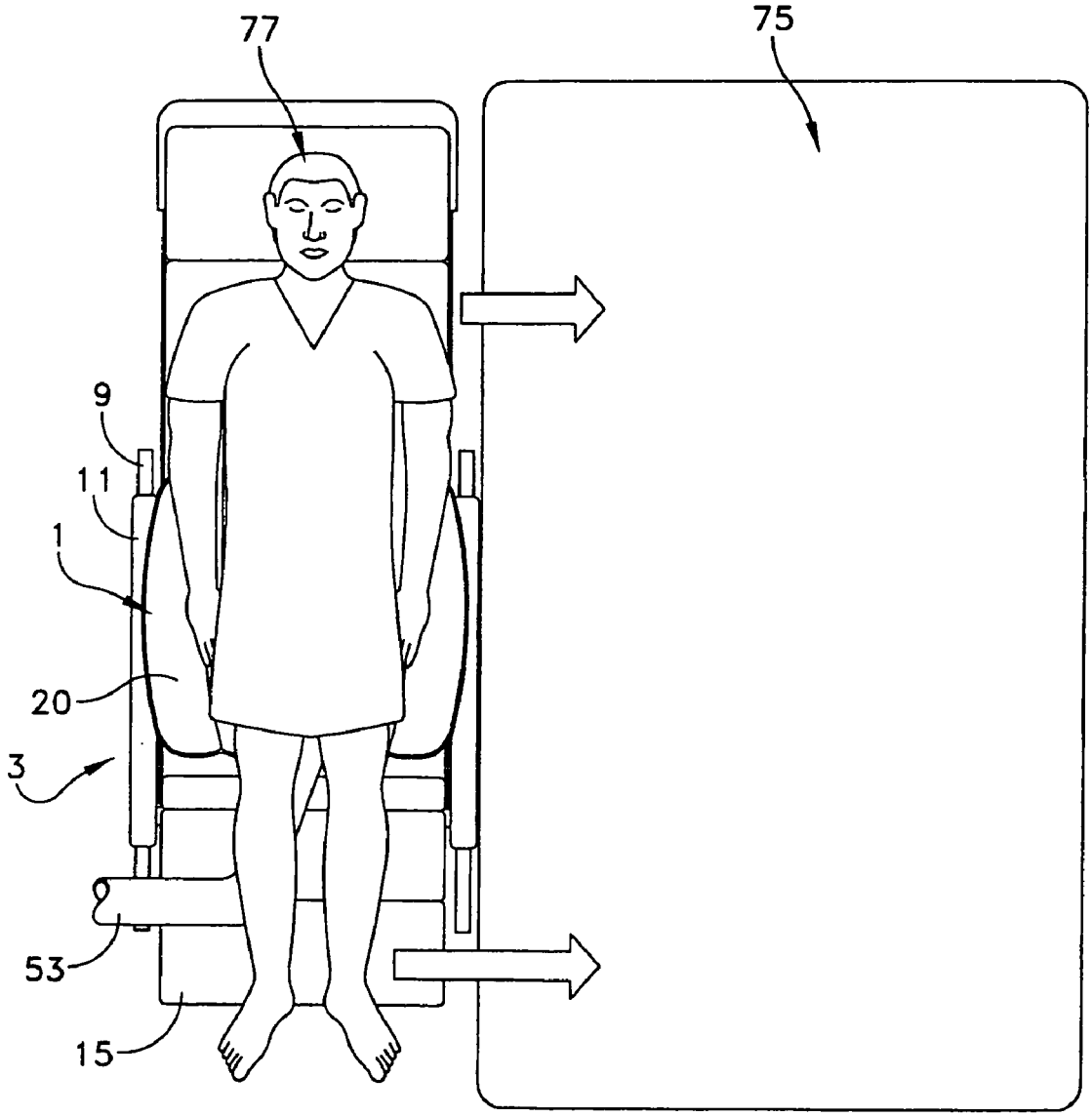
FIG. 9 is a top plan view of a patient positioned atop a fully inflated lifting cushion and articulated chair adjacent to a bed.
Figure 10:
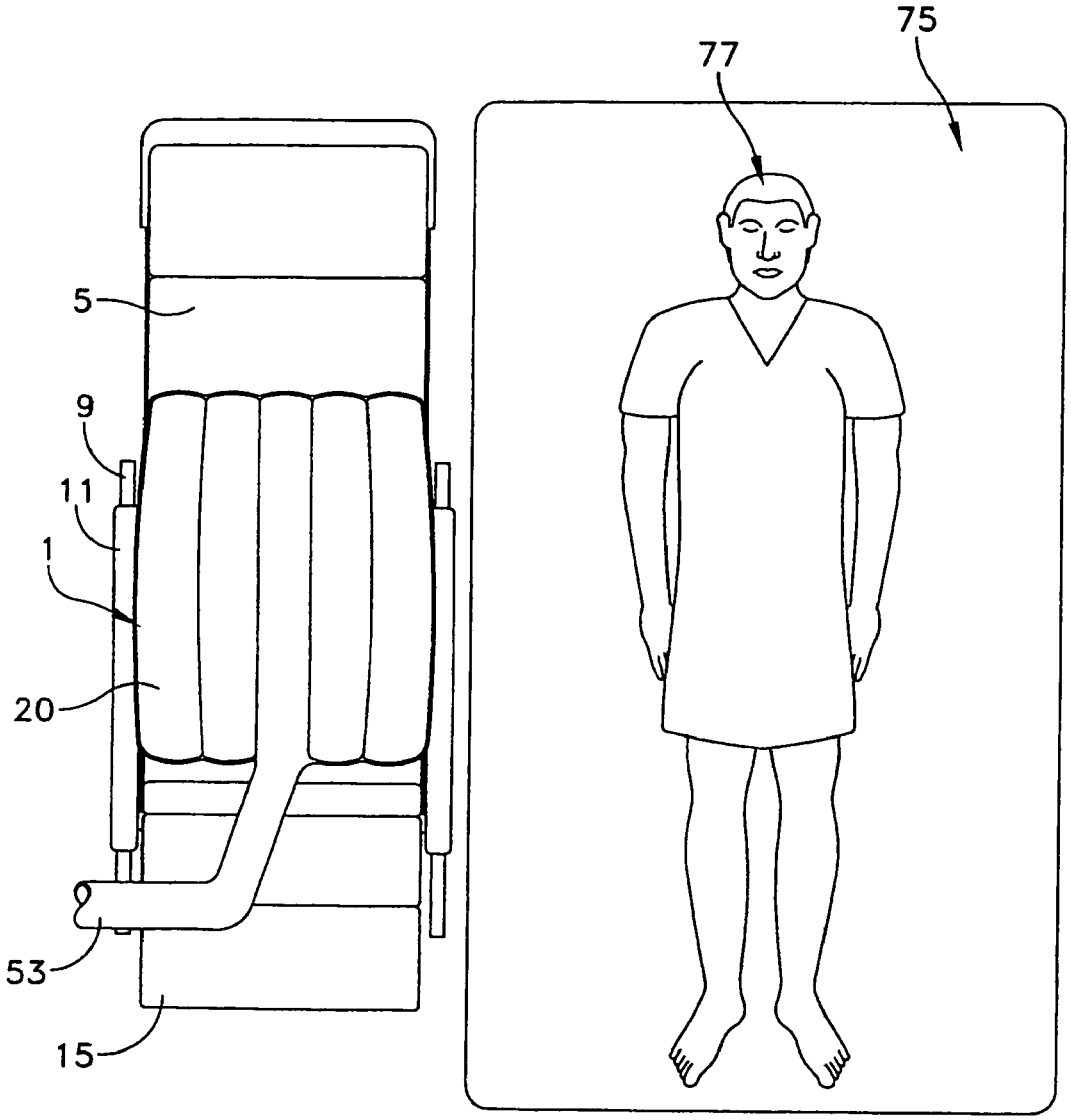
FIG. 10 is a top plan view, similar to FIG. 9, showing the patient after transfer from the lifting cushion and articulated chair into the bed.

Once lifting cushion 1 has been placed on chair 3, patient 77 may be seated in chair 3 so that his lower back and rump are in contact with top wall 20 of lifting cushion 1. Once in this position, patient 77 may be lifted to a lateral transfer height for transfer to bed 75 by simply inflating lifting cushion 1. More particularly, a fluid, e.g., air or the like, is pumped under pressure through conduit 53 and conduit opening 50 into air chamber 37. The inflating fluid passes through central openings 43 and causes top wall 20 to move away from back wall 23 and front wall 26. As this happens, patient 77 begins to move upwardly, away from back 5 and seat 7 of chair 3. Once lifting cushion 1 has been fully inflated so as to obtain its wedge-shaped final configuration, patient 77 will be elevated such that their back and rump will be substantially co-planer with the top surface of bed 75 (FIGS. 8 and 9). Advantageously, side walls 29 and 31 bulge outwardly so as to engage a portion of each side rail 9, thereby retaining and stabilizing lifting cushion 1 atop chair 3. Once this is positioned, patient 77 may be slid or rolled over padded rail 11 and on to the top surface of bed 75 (FIG. 9).

Figure 11:
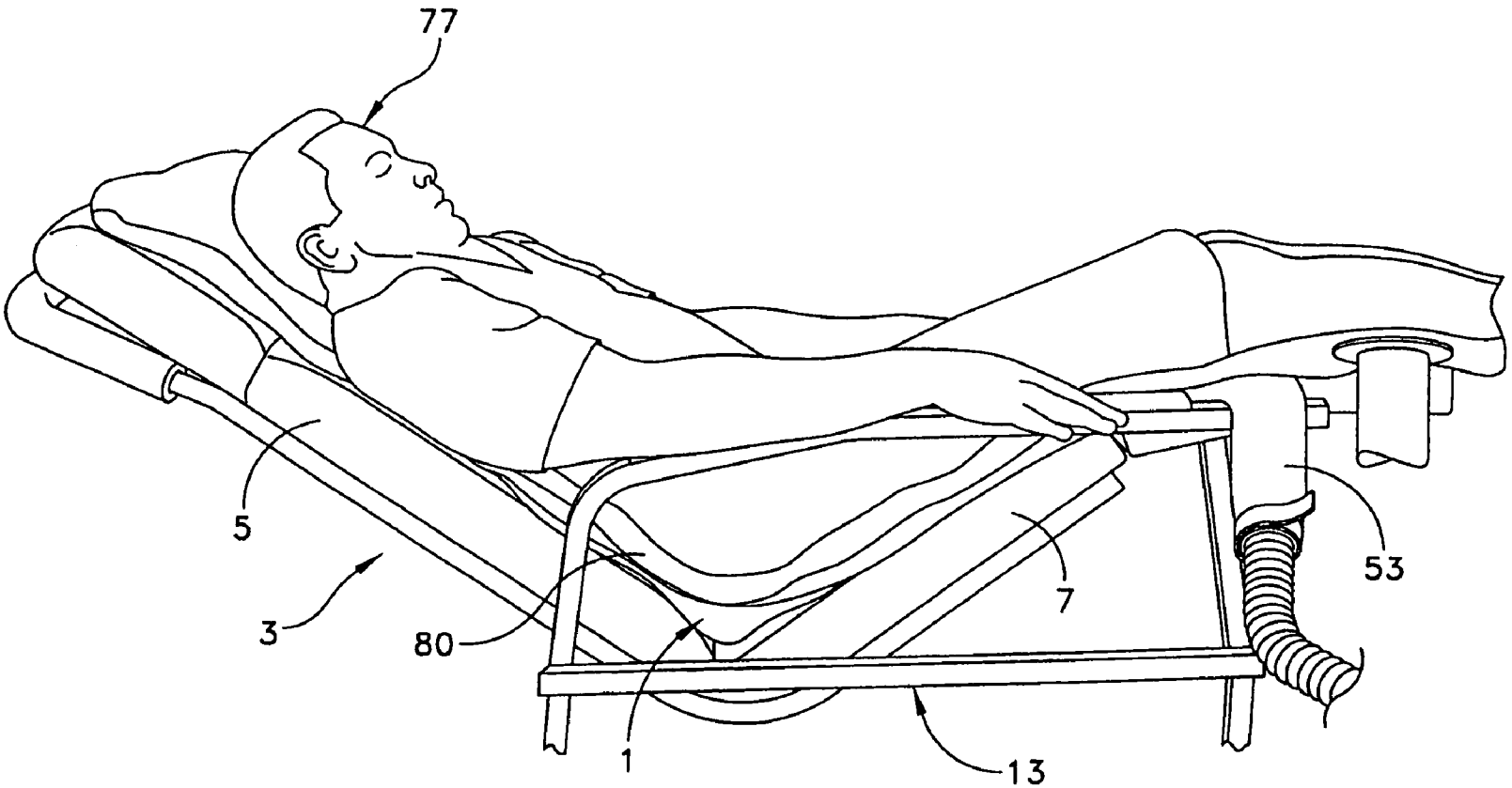
FIG. 11 is a perspective view of a patient positioned atop a transfer mattress which is positioned atop a lifting cushion on an articulated chair in accordance with an alternative embodiment of the present invention.
Figure 12:
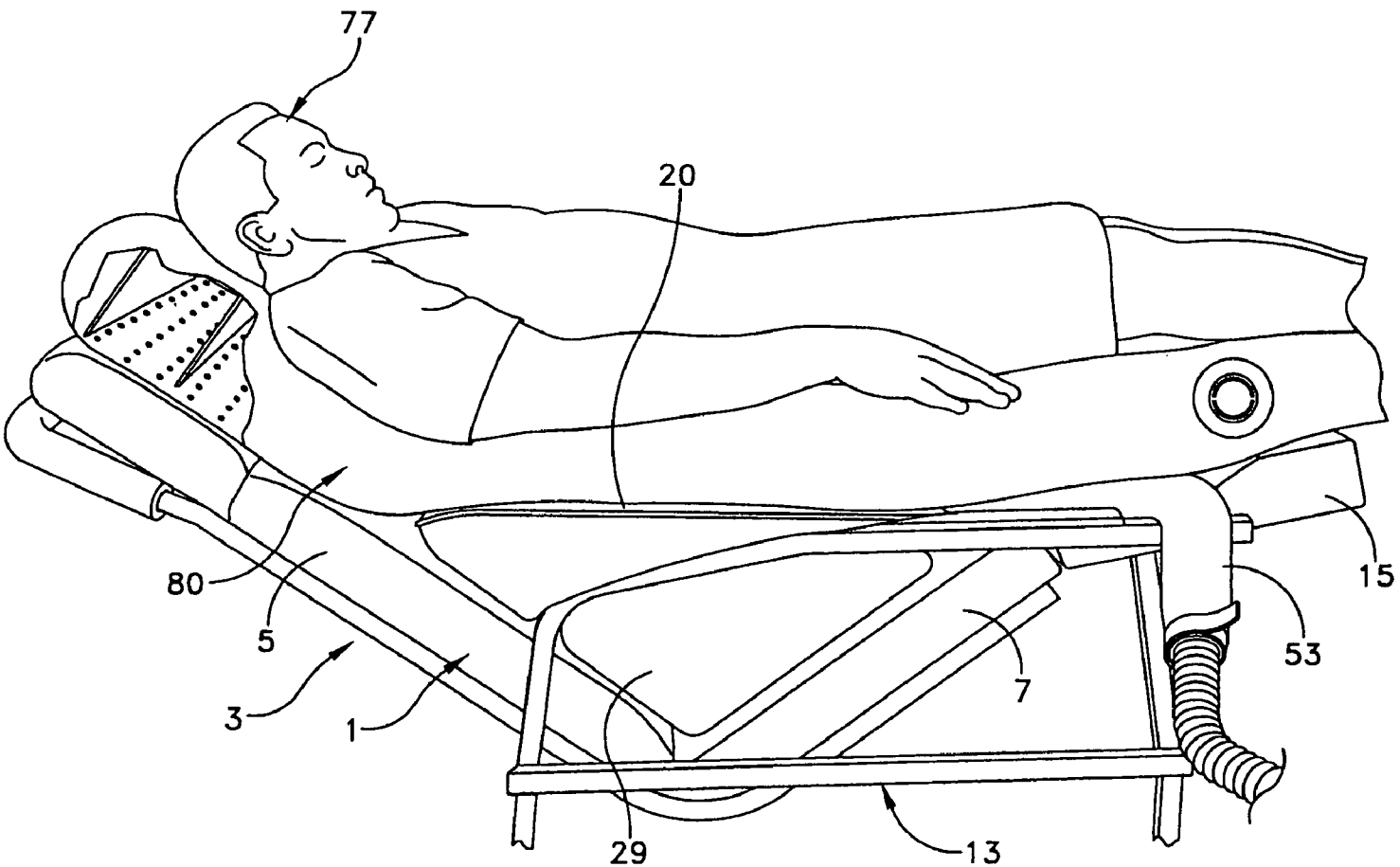
FIG. 12 is a perspective view, similar to FIG. 11, showing both the lifting cushion and transfer mattress fully inflated.

In an alternative embodiment of the present invention, a transfer mattress such as the one disclosed in U.S. Pat. No. 6,073,291, issued to Davis, and incorporated herein by reference, may be positioned atop lifting cushion 1 to further improve the transfer of patient 77 to bed 75. More particularly, a transfer mattress 80 suitable for use with the present invention will often include at least two flexible material sheets, that together define a plenum chamber, with at least one sheet being perforated with small pinholes over at least a central surface area, and which open up directly to the interior of the plenum chamber. When transfer mattress 80 is charged with pressurized air, the escape of air under pressure through the pinholes acts initially to jack patient 77 above the perforated flexible sheet (FIGS. 11 and 12) so as to create an air bearing of relatively small height between the outer surface of top wall 20 and the perforated flexible sheet.

Figure 13:
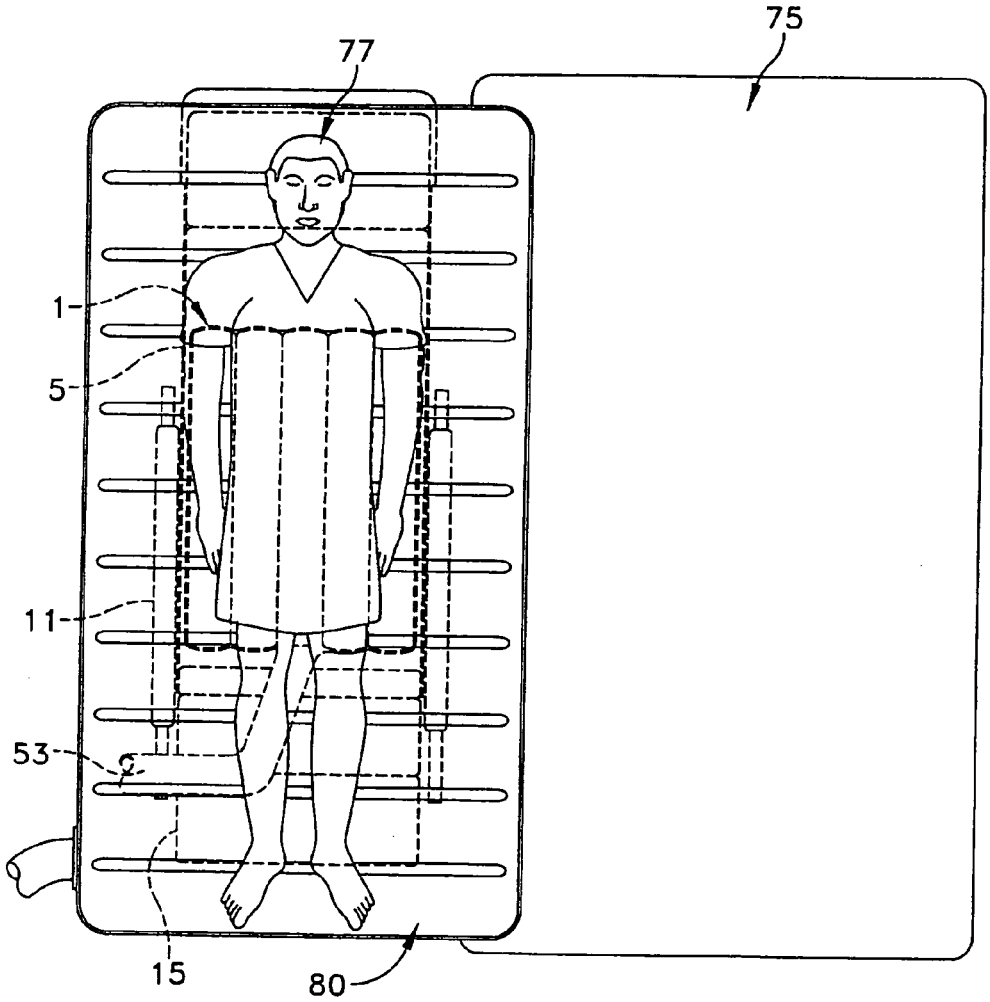
FIG. 13 is a top plan view, partially in phantom, showing a patient positioned atop a fully inflated transfer mattress and fully inflated lifting cushion on an articulated chair and adjacent to a bed just prior to lateral transfer.
Figure 14:
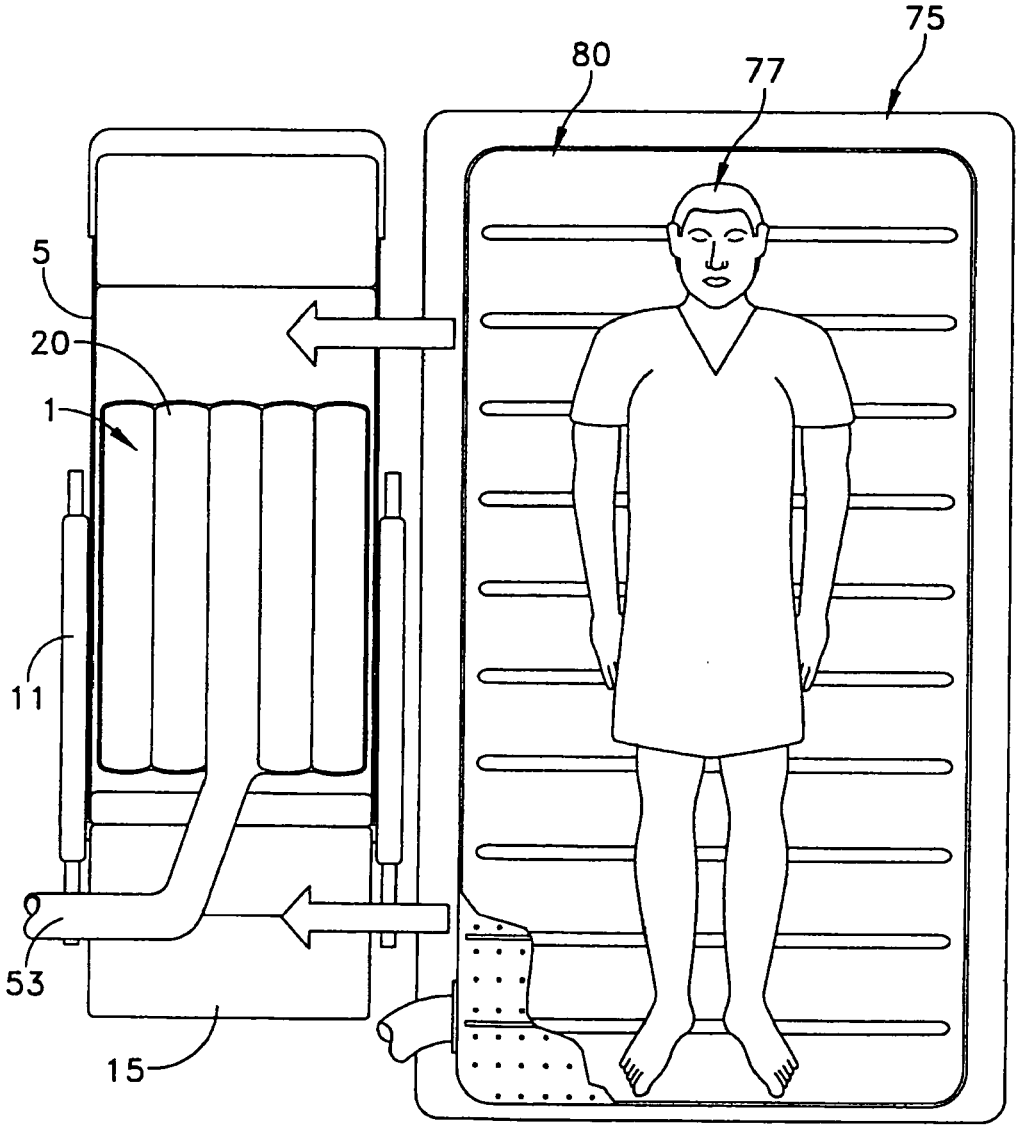
FIG. 14 is a top plan view showing a patient positioned atop a fully inflated transfer mattress located on the top surface of a bed and about to be transferred back to an articulated chair having a fully inflated lifting cushion.

Patient 77 may be transferred using transfer mattress 80 by first inflating lifting cushion 1 as described hereinabove and then inflating transfer mattress 80. Once inflated, and positioned adjacent bed 75, a nurse or health care worker need merely to slide transfer mattress 80 off of chair 3 and top wall 20 of lifting cushion 1 to position the patient 77 atop bed 75 (FIGS. 13 and 14). Once atop bed 75, transfer mattress 80 may be deflated so as to position the patient on bed 75.

It is to be understood that the present invention is by no means limited only to the particular constructions herein disclosed and shown in the drawings, but also comprises any modifications or equivalents within the scope of the claims.

What is claimed is:

1. An inflatable lifting cushion for an articulated chair comprising:

a five-sided polygon capable of being longitudinally aligned on an articulated chair and including triangular side walls and at least one interior plenum having an air inlet port enabling air to enter and exit said plenum, such that when air fills said plenum so that said inflatable lifting cushion is fully inflated, said triangular side walls bulge outwardly so as to engage a portion of said articulated chair and thereby retain said inflatable lifting cushion in position on said articulated chair.

2. An inflatable lifting cushion according to claim 1 comprising a wedge-shaped, five-sided polyhedron having a rectangular top wall, a rectangular back wall, a rectangular front wall, and wherein said triangular side walls are spaced apart and confronting one another.

3. An inflatable lifting cushion according to claim 2 wherein said top wall is formed from a discrete sheet of nylon scrim.

4. An inflatable lifting cushion according to claim 2 wherein said top wall is formed from a discrete sheet of nylon scrim that is coated on at least its outer surface with a water proof coating.

5. An inflatable lifting cushion according to claim 2 wherein said back wall and said front wall form portions of a single sheet of material.

6. An inflatable lifting cushion according to claim 2 wherein said back wall and said front wall each are formed from a single sheet of material.

7. An inflatable lifting cushion according to claim 2 wherein said triangular side walls comprise discrete sheets of nylon scrim.

8. An inflatable lifting cushion according to claim 2 wherein said triangular side walls are arranged so as to be parallel with one another and perpendicularly aligned with said top wall, said back wall, and said front wall when said inflatable lifting cushion is partially inflated.

9. An inflatable lifting cushion according to claim 2 wherein the lengths of said top wall and said side walls are approximately equal to one another.

10. An inflatable lifting cushion according to claim 2 wherein an interior angle between said top wall and both said back wall and said front wall is about 43° to 48° when air fills said plenum so that said inflatable lifting cushion is fully inflated.

11. An inflatable lifting cushion according to claim 2 wherein an interior angle between said top wall and both said back wall and said front wall is about 45° when air fills said plenum so that said inflatable lifting cushion is fully inflated.

12. An inflatable lifting cushion according to claim 2 wherein an interior angle between said back wall and said front wall and said side walls is about 87° to 93° when air fills said plenum so that said inflatable lifting cushion is fully inflated.

13. An inflatable lifting cushion according to claim 2 wherein an interior angle between said back wall and said front wall and said side walls is about 90° when air fills said plenum so that said inflatable lifting cushion is fully inflated.

14. An inflatable lifting cushion according to claim 2 comprising at least two transversely aligned air chambers that are structurally separated from one another by one or more stringers that are affixed to and extend between the interior surfaces of said top wall, said back wall, and said base wall.

15. An inflatable lifting cushion according to claim 14 wherein said stringers comprise a substantially triangular shape having a central opening formed so as to allow for the passage of an inflating fluid between adjacent ones of said air chambers.

16. An inflatable lifting cushion according to claim 15 wherein said stringers are attached to interior facing surfaces of said top wall, said back wall, and said front wall so as to provide for reduced radial bulging.

17. An inflatable lifting cushion according to claim 16 comprising a conduit opening provided in a corner formed by an intersection of said top wall and said front wall that is sized and shaped so as to be attached to a source of pressurized fluid.

18. An inflatable lifting cushion according to claim 14 wherein said triangular side walls are not attached to said stringers, and therefore have a tendency to bulge outwardly when said lifting cushion is fully inflated.

19. An inflatable lifting cushion for an articulated chair comprising:

a rectangular top wall, a back wall, a base wall, and a pair of spaced apart triangular side walls assembled so as to form a five-sided polyhedron capable of being longitudinally aligned on an articulated chair and including a plurality of communicating interior chambers, and having an air inlet port enabling air to enter and exit said interior chambers, such that when air fills said plenum so that said inflatable lifting cushion is fully inflated, said triangular side walls bulge outwardly so as to engage a portion of said articulated chair and thereby retain said inflatable lifting cushion in position on said articulated chair.

* * * * *